US005685224A

United States Patent [19]

Dean et al.

[11] Patent Number: 5,685,224

[45] Date of Patent: Nov. 11, 1997

[54] COLORING DEVICE

[75] Inventors: Bryan L. Dean, Torrington; Victor G. Reiling, Jr., Lakeville, both of Conn.

[73] Assignee: Binney & Smith Inc., Easton, Pa.

[21] Appl. No.: 516,835

[22] Filed: Aug. 18, 1995

[51] Int. Cl.[6] ..... B41F 5/00

[52] U.S. Cl. ..... 101/328; 101/375; 401/208

[58] Field of Search ..... 101/328, 375; 401/208, 218; D18/15

[56] References Cited

U.S. PATENT DOCUMENTS

| | | | |
|---|---|---|---|
| 193,813 | 8/1877 | Gash | 401/208 |
| D. 306,465 | 3/1990 | Klundt | D21/61 |
| 487,396 | 12/1892 | Siegert | 401/185 |
| 519,051 | 5/1894 | Terry | 401/208 |
| 555,411 | 2/1896 | Thain | 446/19 |

(List continued on next page.)

FOREIGN PATENT DOCUMENTS

| | | | |
|---|---|---|---|
| 841959 | 5/1970 | Canada | 101/126 |
| 192655 | 12/1907 | Germany | 401/48 |
| 63187 | 9/1913 | Germany | 401/208 |
| 53265 | 7/1910 | Switzerland | 401/220 |
| 184380 | 6/1936 | Switzerland | 401/208 |
| 1282259 | 7/1972 | United Kingdom . | |

OTHER PUBLICATIONS

Numbering Machines by Lethaby, Lithoweek, p. 34 Oct. 7, 1987.

Two (2) photocopies of the packaging and seven (7) color photographs of the product and packaging for Giant Bubble Gun by Cap Toys, Inc. of Cleveland, Ohio © 1993.

Two (2) photocopies of the packaging and seven (7) color photographs of the product and packaging for Bubble Blaster by Hart Enterprises Inc. of Vancouver, Washington © 1994.

One photocopy of packaging and two color photographs of product and packaging for Bubble Jumper by Cap Toys, Cleveland, Ohio © 1991.

Seven color photographs of squeeze bubble product entitled "Blastos", purchased in a store in approximately Aug. 1994.

Two color photographs of hoop and circular tray product entitled "Fantastic Bubbles" Imperial Toy Corporation, © 1993.

Three color photographs of white and pink bubble pipe product, Imperial, © 1993.

Five color photographs of pink, orange and purple tube product, Imperial, © 1993.

Six color photographs of orange, yellow and blue bubble blower product, Fischer–Price, © 1992.

Five color photographs of pink tube and green container product entitled "Bubblos" purchased in a store in approximately Aug. 1994.

Colorblaster Drawing System, submitted as a reference in U.S. Patent 5,322,220 on Jun. 1, 1993.

*Primary Examiner*—Edgar S. Burr
*Assistant Examiner*—Dave A. Ghatt
*Attorney, Agent, or Firm*—Leydig, Voit & Mayer, Ltd.

[57] ABSTRACT

A coloring device for transferring coloring materials from a writing or drawing instrument to a surface is disclosed. The coloring device includes a housing having a holder to hold a writing instrument, and, a roller connected to the housing for rotation about an axis. The roller is position to contact a writing instrument disposed in the holder to obtain coloring material therefrom and is further positioned to contact a surface to transfer the coloring material obtained from the writing instrument thereto as the roller rotates about the axis. In accordance with one optional aspect of the invention, the coloring device can be further provided with means for rotating the roller. These means may comprise a motor, a hand crank, or any other equivalent structure that can impart rotational motion to the roller. If the means for rotating is excluded, the roller is rotated by moving the coloring device such that the roller rolls against the surface to be marked.

53 Claims, 10 Drawing Sheets

U.S. PATENT DOCUMENTS

| | | | |
|---|---|---|---|
| 637,832 | 11/1899 | Rosenberg | 401/208 |
| 692,524 | 2/1902 | Kasnicka | 401/261 |
| 833,964 | 10/1906 | Herman | 401/208 |
| 852,214 | 4/1907 | Beckman | 401/208 |
| 1,014,759 | 1/1912 | Kovacs | 446/149 |
| 1,016,143 | 1/1912 | Hansen | 239/143 |
| 1,099,344 | 6/1914 | Desenberg et al. | 401/185 |
| 1,205,123 | 11/1916 | Bradway | 446/19 |
| 1,218,279 | 3/1917 | Kopinski | 239/371 |
| 1,272,752 | 7/1918 | Wold | 239/415 |
| 1,477,479 | 2/1923 | Evans | 101/123 |
| 1,862,430 | 6/1932 | Robb | 401/279 |
| 2,163,355 | 6/1939 | Sechrist | 132/79 |
| 2,165,812 | 7/1939 | Pfleger | 91/62.6 |
| 2,587,536 | 2/1952 | Scott | 46/8 |
| 2,587,537 | 2/1952 | Scott | 46/8 |
| 2,606,396 | 8/1952 | Hill | 46/8 |
| 2,712,704 | 7/1955 | Mason | 41/19 |
| 2,716,826 | 9/1955 | Huebner | 41/1 |
| 2,970,569 | 2/1961 | Heynau | 120/9 |
| 3,003,468 | 10/1961 | Rosenthal | 120/42.2 |
| 3,042,573 | 7/1962 | Roberts | 156/285 |
| 3,091,403 | 5/1963 | Schraber et al. | 239/413 |
| 3,111,796 | 11/1963 | Meissner | 53/38 |
| 3,141,403 | 7/1964 | Brown et al. | 101/106 |
| 3,179,089 | 4/1965 | Civitarese | 120/98 |
| 3,211,088 | 10/1965 | Naiman | 101/114 |
| 3,304,573 | 2/1967 | Stefely | 15/553 |
| 3,323,250 | 6/1967 | Gibbons | 46/6 |
| 3,374,050 | 3/1968 | Rabin et al. | 401/208 |
| 3,429,642 | 2/1969 | Underwood | 401/16 |
| 3,443,337 | 5/1969 | Ehrlich | 46/6 |
| 3,465,673 | 9/1969 | Oppenheim | 101/328 |
| 3,554,450 | 1/1971 | D'Muhala | 239/309 |
| 3,584,571 | 6/1971 | Schmoll | 101/1 |
| 3,850,532 | 11/1974 | Kaiser | 401/219 |
| 3,866,838 | 2/1975 | Miles | 239/372 |
| 3,921,858 | 11/1975 | Bemm | 222/146 HE |
| 3,971,157 | 7/1976 | Gillis | 46/7 |
| 3,995,581 | 12/1976 | Smejda | 118/7 |
| 4,023,526 | 5/1977 | Ashmus et al. | 118/410 |
| 4,062,286 | 12/1977 | Ford | 101/375 |
| 4,146,362 | 3/1979 | Nichols, Jr. | 8/1 |
| 4,162,342 | 7/1979 | Schwartz | 428/159 |
| 4,175,300 | 11/1979 | McGlew et al. | 401/197 |
| 4,205,481 | 6/1980 | Tomson | 46/6 |
| 4,257,185 | 3/1981 | Tomson | 46/6 |
| 4,275,656 | 6/1981 | Choma | 101/211 |
| 4,628,644 | 12/1986 | Somers | 51/427 |
| 4,630,952 | 12/1986 | Elbaum | 401/48 |
| 4,775,348 | 10/1988 | Collins | 446/16 |
| 4,923,426 | 5/1990 | Klundt | 446/19 |
| 4,943,255 | 7/1990 | Klundt | 446/15 |
| 4,951,876 | 8/1990 | Mills | 239/117 |
| 5,088,903 | 2/1992 | Tomatsu | 417/473 |
| 5,131,598 | 7/1992 | Hoogeveen, Jr. | 239/223 |
| 5,156,684 | 10/1992 | Mayer et al. | 118/301 |
| 5,190,220 | 3/1993 | Bolton | 239/305 |
| 5,224,893 | 7/1993 | Routzong et al. | 446/15 |
| 5,230,577 | 7/1993 | Cox et al. | 401/68 |
| 5,322,220 | 6/1994 | Rehkemper | 239/214 |
| 5,435,245 | 7/1995 | Salisbury et al. | 101/328 |
| 5,445,074 | 8/1995 | Malin et al. | 101/91 |
| 5,490,738 | 2/1996 | Pearce | 401/208 |

COLORING DEVICE

FIELD OF THE INVENTION

This invention relates generally to coloring devices and more particularly to a coloring device for transferring coloring material from a writing instrument to a surface.

BACKGROUND OF THE INVENTION

Artists and children have long found it desirable and enjoyable to apply coloring materials such as paints, chalk, inks, crayon materials and pencil markings to surfaces to create images and other visual effects. Typically, they have applied these materials using traditional artists' instruments such as pencils, pens, markers, paint brushes, paint rollers, sticks of chalk, paint stick and crayons. These instruments have been used to create a wide range of visual effects with varying success. However, while paint brushes and rollers have been provided which enable an artist to rapidly apply paint over a relatively large surface area, for the most part artists' instruments have been configured as writing or drawing instruments with relatively small marking tips that require a relatively large amount of effort and time to apply their coloring or marking materials over a relatively large surface area.

OBJECTS OF THE INVENTION

It is, therefore, a general object of the invention to provide an improved coloring device for transferring coloring material from a writing instrument to a surface. It is a related object of the invention to provide a coloring device that can be used to cover a relatively large area with coloring material in a relatively short period of time.

It is another object to provide a coloring device which offers artists and children a new way to create images and visual effects. It is a related object to provide a coloring device which offers users a new and enjoyable way to transfer coloring materials from a writing or drawing instrument such as a marker, a crayon or a pen to a surface.

SUMMARY OF THE INVENTION

The present invention accomplishes these objectives by providing a coloring device for transferring coloring material from a writing instrument to a surface. The coloring device includes a housing including a holder to hold a writing instrument, and, a roller connected to the housing for rotation about an axis. The roller is positioned to contact a writing instrument disposed in the holder to obtain coloring material therefrom and is further positioned to contact a surface to transfer the coloring material obtained from the writing instrument thereto as the roller rotates about the axis.

In accordance with one aspect of the invention, the coloring device can be further provided with means for rotating the roller. These means may comprise a motor, a hand crank, or any other equivalent structure that can impart rotational motion to the roller. If the means for rotating is excluded, the roller is rotated by moving the coloring device such that the roller rolls against the surface to be marked.

In accordance with a further aspect of the invention, the coloring device can be optionally provided with an insert. This insert can be removably coupled to the holder to adapt the holder to secure writing instruments having a cross-section different than the cross-section of the instruments the holder typically secures without the insert.

In accordance with yet another aspect of the invention, the coloring device can be optionally provided with a stencil having at least one opening for exposing at least one predetermined area of the surface to be marked to the roller to create a predetermined image.

These and other features and advantages of the invention will be more readily apparent upon reading the following description of the preferred embodiment of the invention and upon reference to the accompanying drawings.

DESCRIPTION OF THE EMBODIMENTS

Figure 1:
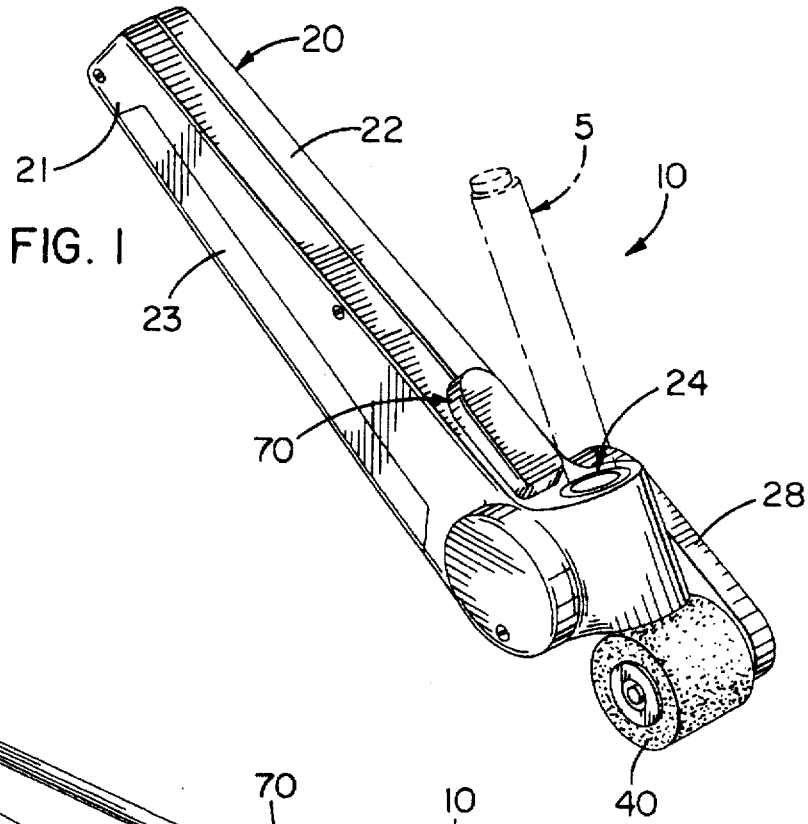
FIG. 1 is a left, front perspective view of a coloring device constructed in accordance with the teachings of the invention.
Figure 2:
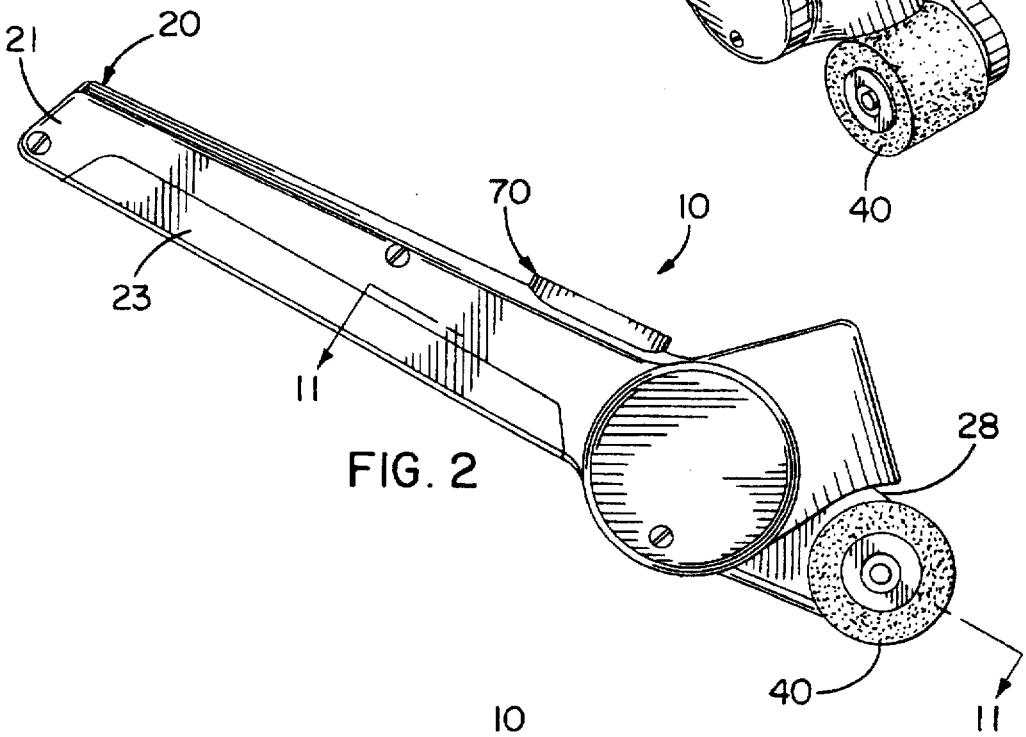
FIG. 2 is a left side view of the coloring device of FIG. 1.
Figure 3:
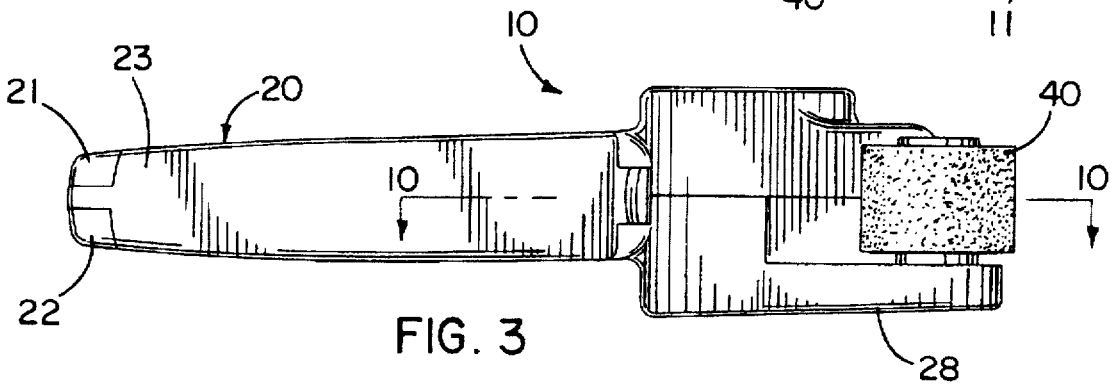
FIG. 3 is a bottom view of the coloring device of FIG. 1.
Figure 4:
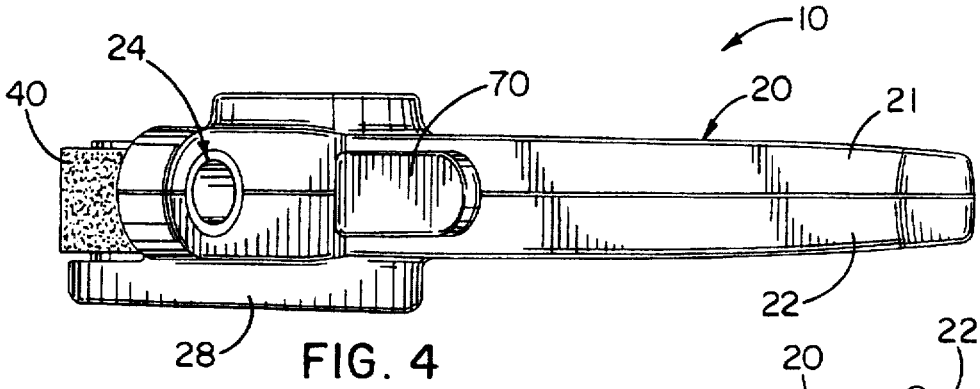
FIG. 4 is a top view of the coloring device of FIG. 1.
Figure 5:
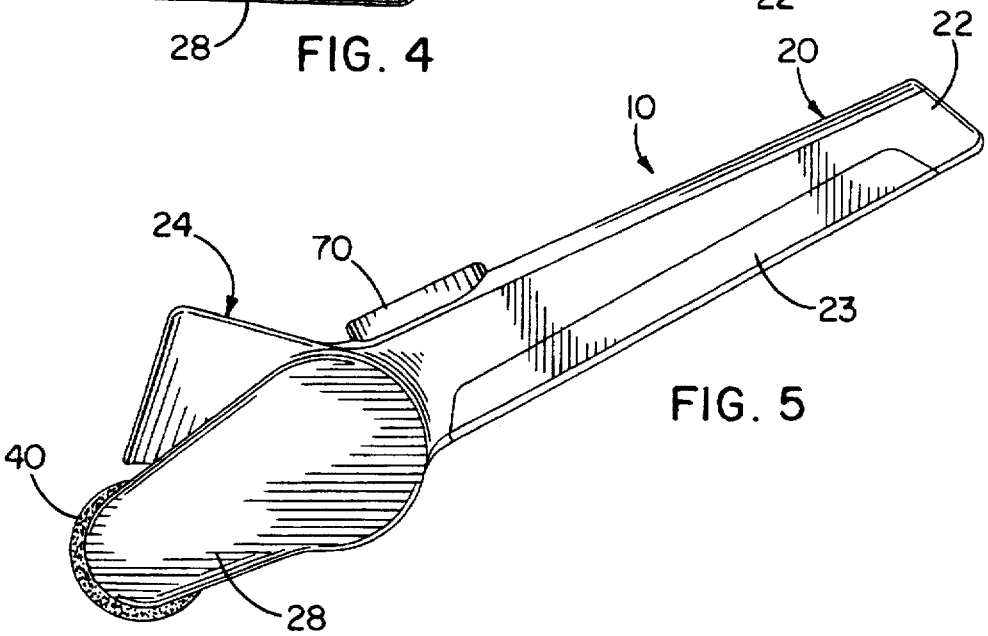
FIG. 5 is a right side view of the coloring device of FIG. 1.
Figure 6:
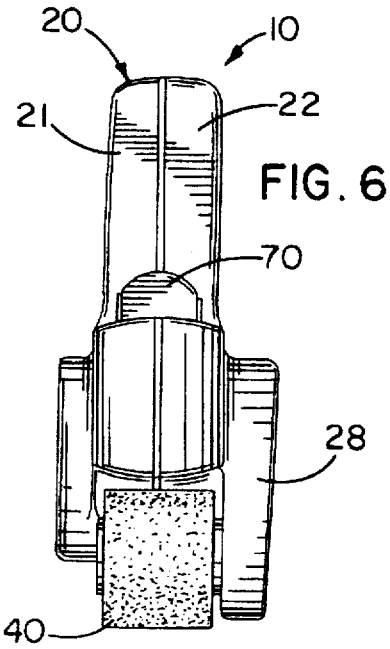
FIG. 6 is a front view of the coloring device of FIG. 1.
Figure 7:
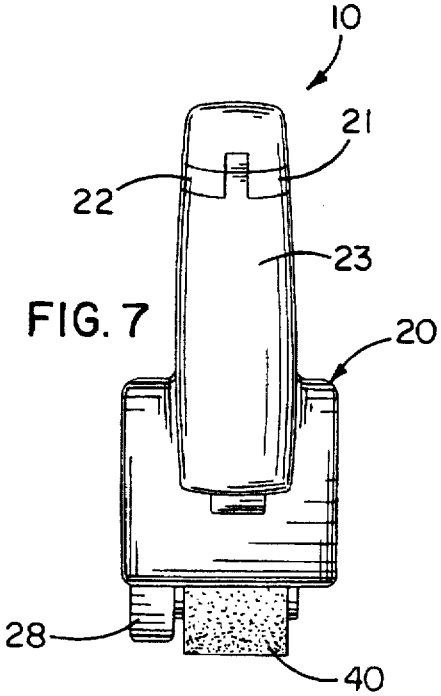
FIG. 7 is a rear view of the coloring device of FIG. 1.
Figure 10:
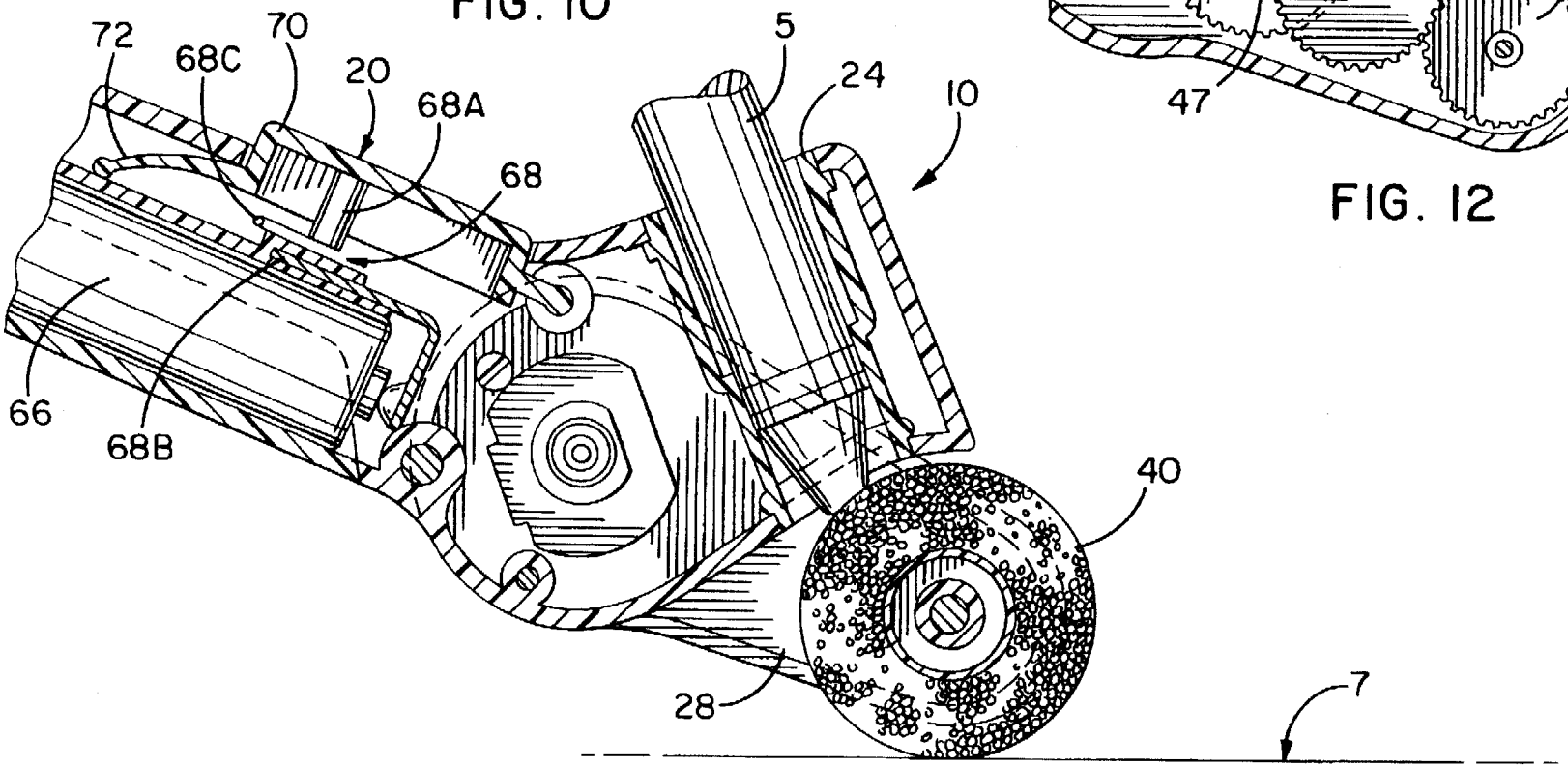
FIG. 10 is a partial cross sectional view taken along line 10—10 of FIG. 3.

FIG. 1 illustrates generally a coloring device 10 constructed in accordance with the teachings of the instant invention. The illustrated coloring device 10 is designed and constructed to transfer coloring materials such as crayon materials, inks, paints, chalk, and the like from a writing or drawing instrument 5 such as a crayon, marker, pencil, pen, stick of chalk, paint stick or the like to a surface to be marked. To this end, the coloring device 10 is provided with a housing 20 having a holder 24 for holding a writing/drawing instrument 5; and a roller 40 which is connected to the housing 20 for rotation about an axis. As most easily seen in FIG. 10, the roller 40 is positioned to contact a writing/drawing instrument 5 disposed in the holder 24 of the housing. Thus, as the roller 40 rotates, it obtains coloring material from the writing instrument 5. If the user places the roller 40 in contact with a surface to be marked 7 as illustrated in FIG. 10, the roller 40 will transfer the coloring material obtained from the writing instrument 5 to the surface 7.

As illustrated in FIGS. 1–7, the housing 20, which is preferably constructed from molded plastic, includes a left halve 21, a right halve 22, and a battery compartment door 23. In this embodiment, these components 21, 22, 23 combine to perform two functions. Specifically, they provide support for the various internal components described in detail below and, they also form a handle that enables a user to easily grip and manipulate the coloring device 10.

Figure 9:
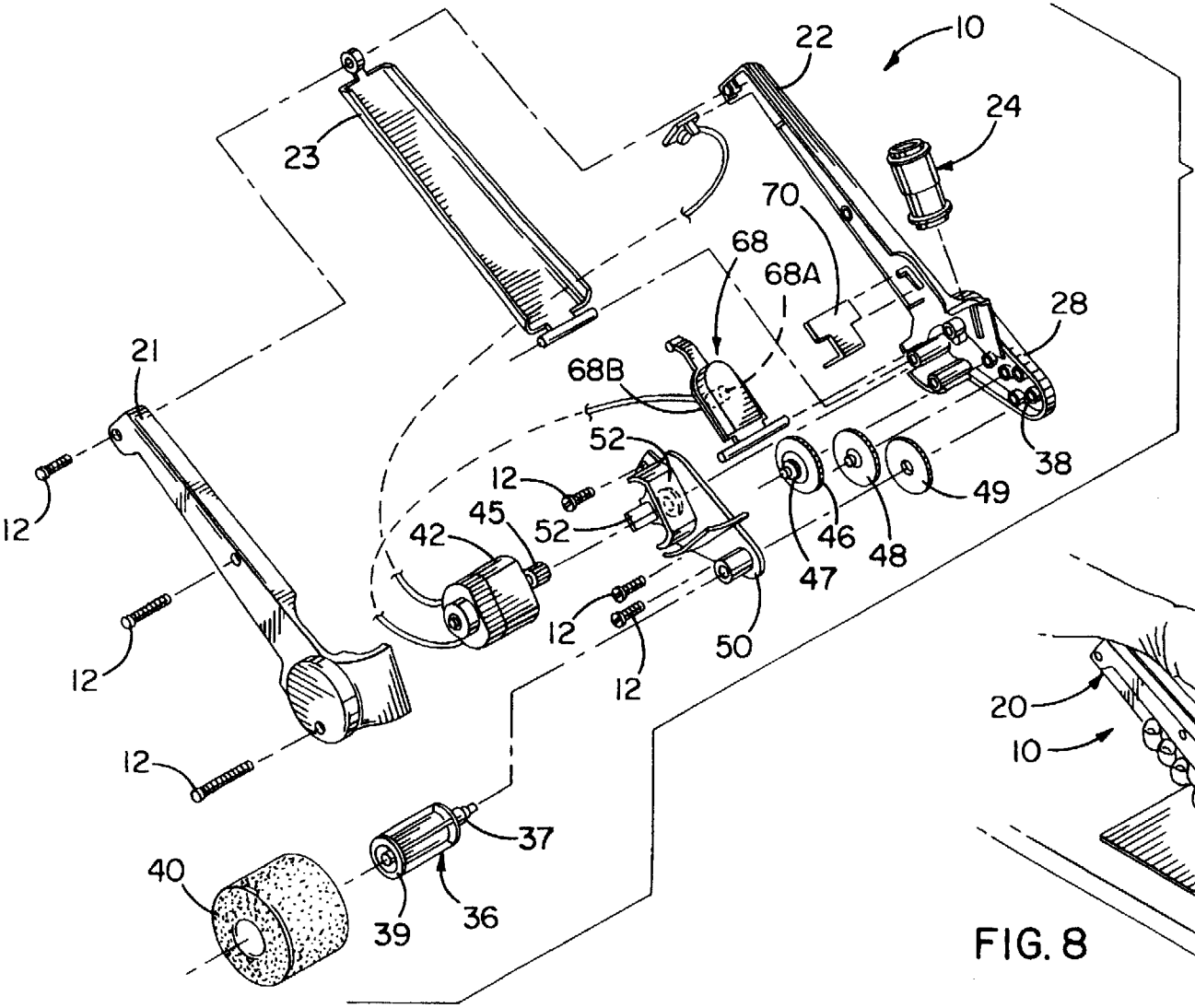
FIG. 9 is an exploded view of the coloring device of FIG. 1.

As shown in FIG. 9, the three housing components 21, 22, 23 are secured together with screws 12. However, those skilled in the art will appreciate that other fastening techniques could likewise be employed. One end of the battery compartment door 23 is preferably pivotably coupled to the left and right halves 21, 22 of the housing 20 to permit easy access to a battery compartment 26 defined in the housing 20. The free end of the battery compartment 26 can be secured to the other components 21, 22 of the housing 20 by any suitable means including a screw or a latch of any configuration. The securing method should preferably prevent the door 23 from inadvertently pivoting to the open position.

As illustrated in FIG. 9, the left and right halves 21, 22 of the housing 20 capture a tubular holder 24 therebetween. The holder 24 is an annular structure with two opposed open ends. Preferably, the channel running between these two end openings is dimensioned to receive and removably secure a writing instrument 5 such as a crayon, a marker, a pencil, a piece of chalk or the like as shown in FIG. 10. As illustrated in FIGS. 1, 4, 8, and 10, a writing or drawing instrument can be inserted through the holder 24 until it contacts the roller 40.

Although the holder 24 of the preferred embodiment of the coloring device 10 is a cylindrical structure with a substantially circular cross-section as described above, those skilled in the art will appreciate that other holders such as clips, rings, clamps and the like, and other cross-sectional shapes such as rectangular, triangular, oval and the like could also be used in this role without departing from the scope or the spirit of the instant invention.

Figure 19:
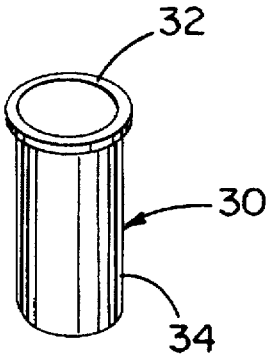
FIG. 19 is a perspective view of an insert.
Figure 17:
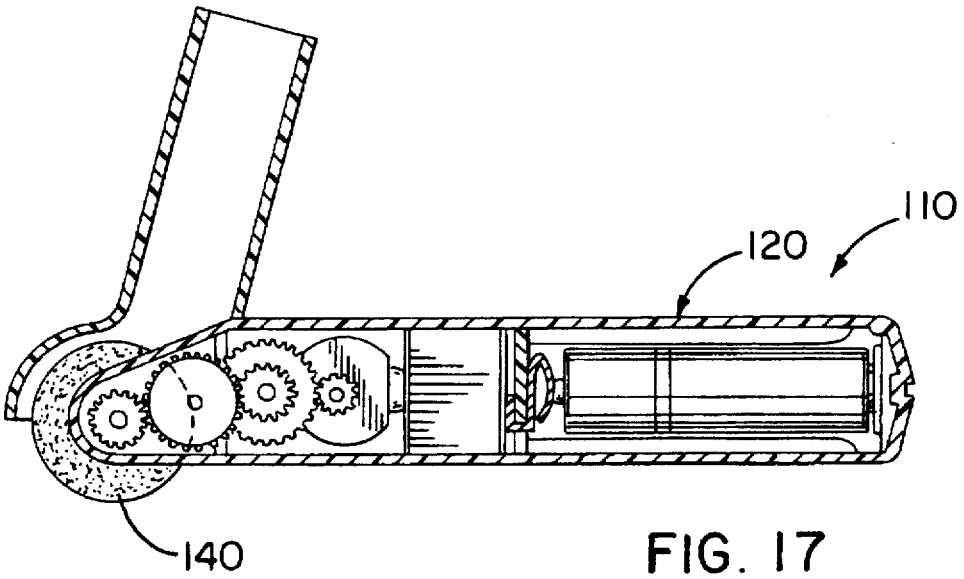
FIG. 17 is a side view of the alternative coloring device of FIG. 14 with the housing removed along line 17—17 of FIG. 14 to reveal the internal components of the coloring device.
Figure 18:
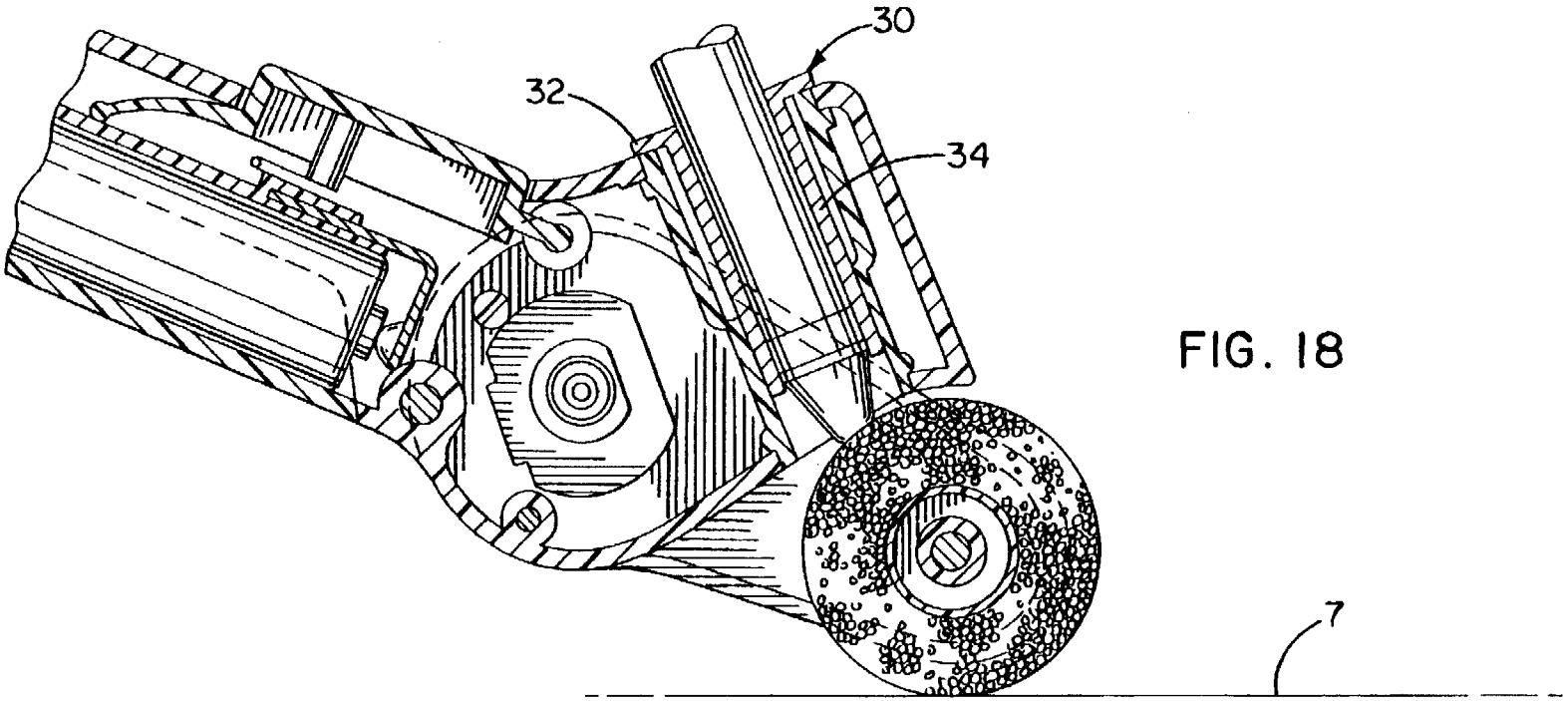
FIG. 18 is a view similar to FIG. 10 but illustrating the coloring device of FIG. 1 being used with an insert and a different sized writing instrument.

In accordance with one optional aspect of the invention, the coloring device 10 can be provided with an optional insert 30 as illustrated in FIGS. 18 and 19. This optional insert 30 can be used to effectively reduce the internal dimensions of the holder 24 to enable the coloring device 10 to more easily operate with writing instruments having a small exterior dimension. As shown in FIG. 19, the insert 30 is an annular structure having an upper lip 32 and a lower cylindrical body 34. The lower body 34 has an exterior dimension that permits it to fit within the holder 24 as shown in FIG. 18. The upper lip 32, on the other hand, is preferably too large to fit within the holder 24. The upper lip 32, thus, facilitates removal from the holder 24 when a user wishes to employ the device 10 with a writing instrument having an exterior dimension that is too large for the insert 30. As noted above with respect to the holder 24, the insert 30 can comprise other means for holding the writing instrument such as clips, rings, and clamps, and the insert 30 can have other interior or exterior cross-sectional shapes such as rectangular, triangular, oval or others without departing from the scope or the spirit of the invention.

As mentioned above, the roller 40 is connected to the housing for rotation about an axis. To this end, the right half 22 of the housing 20 preferably includes an extended arm 28 which serves to support the roller 40 beneath the holder 24 as shown in FIGS. 1–6.

Figure 11:
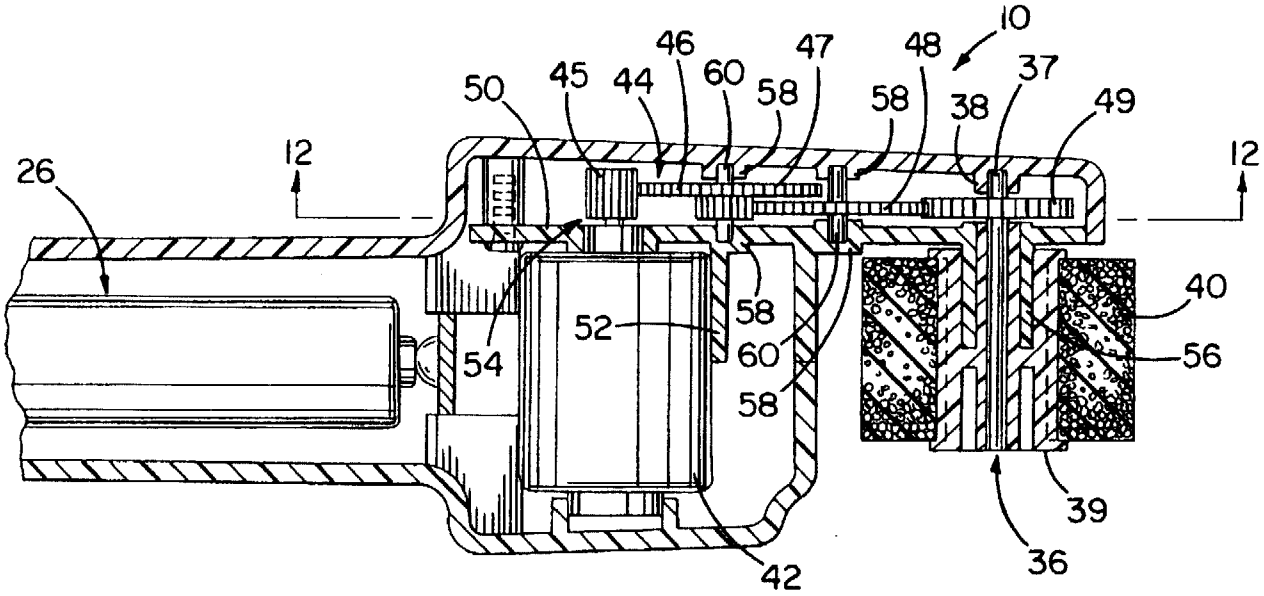
FIG. 11 is a partial cross sectional view taken along line 11—11 of FIG. 2.

In order to permit rotation of the roller 40 relative to the extended arm 28, the housing 20 is further provided with a rotatable spindle 36. As shown in FIGS. 9 and 11, the rotatable spindle 36 is preferably provided with a free end 39 for slidably receiving the roller 40. The opposite end of the spindle 36 forms a trunnion 37 which is rotatably secured in a support 38 provided on the inner wall of the extended arm 28. Thus, when a roller 40 is mounted on the spindle 36, it can rotate relative to the arm 28.

Figure 12:
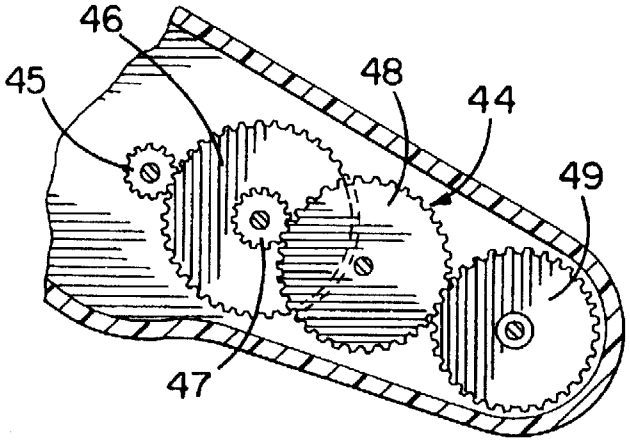
FIG. 12 is a partial cross sectional view taken along line 12—12 of FIG. 11.

In the preferred embodiment, the coloring device 10 is provided with a drive system or means for rotating the roller relative to the arm 28. In the preferred embodiment, this means for rotating is an electrically powered motor 42 coupled to the rotatable spindle 36 via a gear train 44. As shown in FIGS. 9, 11 and 12, the gear train 44 in the illustrated embodiment comprises 5 gears 45, 46, 47, 48, 49 with the first gear 45 being centrally mounted on a drive shaft driven by the motor 42 and the last gear 49 being centrally mounted on the trunnion 37 of the spindle 36. Thus, when the motor 42 rotates its associated drive shaft, it also rotates gear 45 whose rotational motion is transferred through the other gears 46, 47, 48, 49 of the gear train 44 to the spindle 36 and, thus, to the roller 40.

In the illustrated embodiment, a gear train 44 including 5 gears and having a gear ratio of 14.25:1 is employed. Also, in the illustrated embodiment the spindle 36 on the motor 42 rotates at approximately 12,300 RPM when approximately 3 volts and approximately 140 milliamps are supplied by the power supply 66. Thus, the roller 40 rotates at approximately 860 RPM. A representative range of rotational speeds for crayons, markers, pencils, pens and painting sticks is approximately 500–1200 RPM. The motor 42 employed in the illustrated embodiment is manufactured by Mabuchi Industry Co. Ltd. of 19 Sam Chuk St., San Po Kong, Kowloon, Hong Kong, also located at Mabuchi Motor America Corp., 475 Park Ave. South, New York, N.Y. 10016 U.S.A. and is sold under part no. Motor FA 130-18100.

Those skilled in the art will appreciate that other approaches to coupling the rotational force of the motor 42 to the roller 40 such as a belt and pulleys, shaft drive, chain and sprockets, and other coupling means could be employed in place of the gear train 44 without departing from the scope or the spirit of the invention.

In order to support the gear train 44 and the motor 42 within the housing 20, the housing 20 is further provided with an internal support wall 50. As shown in FIGS. 9 and 11, this wall 50 is disposed between the left and right halves 21, 22 of the housing 20. In order to support the motor 42 in a secured position, the internal wall 50 includes two opposed motor support projections 52. A drive shaft opening 54 is defined by the internal wall 50 at a location between the motor support projections 52. The drive shaft opening 54 receives the drive shaft associated with the motor 42 thereby permitting the motor 42 to drive the gear train 44 even though the motor 42 and gear train 44 are mounted on opposite sides of the internal wall 50.

Similarly, the internal wall 50 includes an annular spindle support 56 which serves to support the spindle 36 on one side of the wall 50 while permitting the trunnion 37 of the spindle 36 to interact with the gear train 44 on the opposite side of the wall 50.

In order to support the gear train 44, the internal wall 50 and the interior surface of the right half 22 of the housing 20 are provided with opposed circular supports 58. These opposed circular supports 58 are positioned to each receive and support an end of a shaft 60 passing through one or more gears in the gear train 45. The shafts 60 are mounted for free rotation within the circular supports 58. If desired, the supports 58 and shafts 60 can be lubricated to reduce friction.

Figure 20:
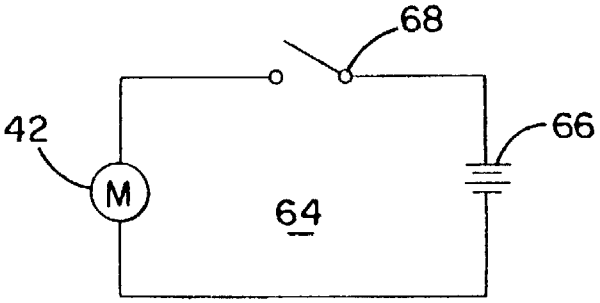
FIG. 20 is a schematic diagram of the circuit employed in the coloring devices of FIGS. 1 and 14.

In order to provide the motor 42 with energy, the coloring device 10 is provided with the electrical circuit 64 schematically illustrated in FIG. 20. That electrical circuit 64 includes a power supply 66 and a manually actuable switch 68 for selectively connecting the motor 42 to the source of power 66. As shown in FIGS. 10 and 11, the power supply 66 of the preferred embodiment comprises two 1.5 volt AA replaceable batteries coupled in series between two opposed electrodes in a manner known in the art.

The switch 68 of the preferred embodiment 10 is a contact switch 68. As shown in FIGS. 9 and 10, this switch 68 includes two opposed electrodes 68A, 68B separated by a short distance 68C. By depressing a pivotable button 70 on the housing 20, a user brings these opposed electrodes 68A, 68B into contact thereby closing the switch 68 and permitting current to flow from the power source 66 to the motor 42. As shown in FIG. 10, the button 70 is provided with an integral leg 72 which acts as a return spring to move the button 70 back to its rest position when the user stops applying force to the button 70. However, those skilled in the art will appreciate that a toggle switch or a variable switch could be substituted for the contact switch 68. The toggle switch stays in the "on" position unless manually switched to the "off" position or vice versa. A variable switch permits the user to vary the speed of the motor by adjusting the position of the switch.

Figure 21:
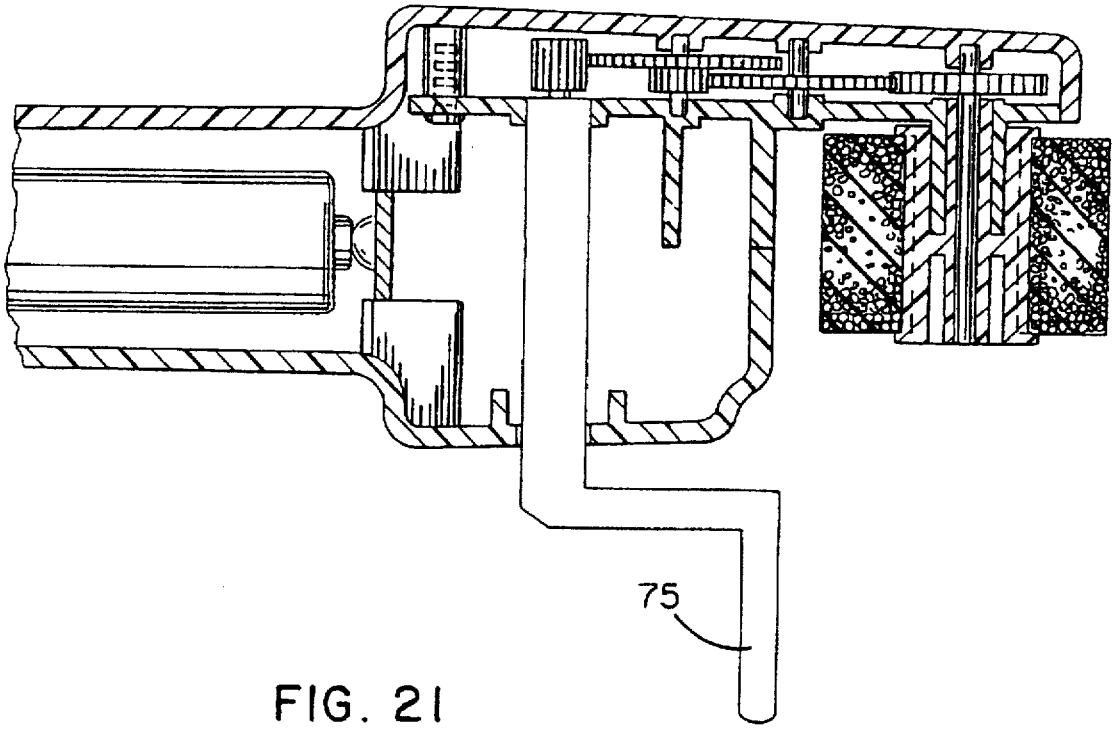
FIG. 21 is a view similar to FIG. 11 but showing an alternative embodiment employing a hand crank as the rotating means.

Although the rotating means employed in the preferred embodiment comprises an electrical motor with associated support circuitry as described above, those skilled in the art will readily appreciate that other rotating means could likewise be employed. For example, as shown in FIG. 21, an external hand crank 75 could be used in place of the motor 42. This hand crank 75, like the motor 42, could include an associated drive shaft which could support a gear in the gear train 44. The drive shaft could, thus, transfer the rotational movement generated by a user turning the hand crank 75 to the gear train 44 which would, in turn, transfer the rotational energy to the spindle 36 and to the roller 40. The hand crank 75, gear train 44 and roller 40 could be designed to achieve the roller rotational speeds noted above. Alternatively, the gear train 44 could be omitted and the crank 75 could be connected directly to the spindle shaft without departing from the scope or the spirit of the invention.

Those skilled in the art will further appreciate that, if desired, the means for rotating can be excluded altogether. If such an approach is taken, a user would rotate the roller 40 by manually rolling the roller 40 along a surface 7 to be marked. The frictional forces between the surface and the roller 40 would cause the roller 40 to rotate past the writing instrument to obtain coloring material and then over the surface 7 to be marked to transfer the coloring materials thereto.

In the preferred embodiment, the roller 40 is an annular structure made of foam that can be slid on and off of the spindle 36. This ease of removal facilitates replacement of the roller 40 if a user desires to switch coloring materials. For example, the user may decide to use a green (or any other color) crayon instead of a white (or any other color crayon) and, thus, may wish to exchange rollers 40 to prevent mixing the two coloring materials. Alternatively, the user can remove the coloring material from the roller 40 by: (1) washing the roller; and/or (2) using the roller by contacting a scrap surface (but without the writing instrument contacting the roller) in order to wear off the coloring material from the roller to the scrap surface.

Those skilled in the art will appreciate that coloring materials of any color including white and black could be used with the inventive coloring device without departing from the scope or the spirit of the instant invention. Preferably, the crayon is manufactured by Binney & Smith Inc. of 1100 Church Lane, Easton, Pa. U.S.A. and sold under the trademark Crayola® and name "Power Color Stick". These crayons are softer than crayons which are usually sold for use by children.

In addition, those skilled in the art will appreciate that, although in the preferred embodiment the roller 40 is made of foam, other materials such as rubber, sponge, cork, a brush with bristles or sandpaper on a roller could likewise be employed in this role without departing from the scope or the spirit of the invention.

Also, although the preferred diameter of the roller is 1.18 inches, rollers having other diameters could be employed in this role without departing from the scope of the invention. Further, although other rollers would likewise be appropriate, the roller employed in the illustrated embodiment is manufactured by TMP Technologies, Inc., 1200 Northland Ave., Buffalo, N.Y. 14215, U.S.A. and sold under part no. Hi-ILD ether. The roller material is a mixture of polyurethane and polyether. The foam material is available from Foamex of 401 Darlington Street, LaPorte, Ind. U.S.A. under identification number GC 220125N.

Figure 12A:
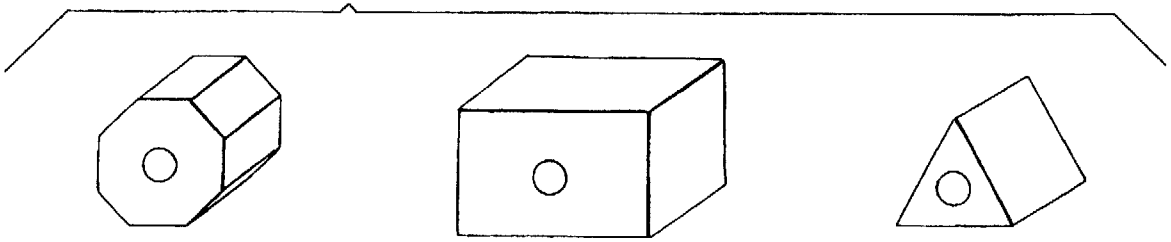
FIG. 12A is a perspective view of rollers with an octagonal, a rectangular and a triangular shapes.

Finally, it should be noted that, for purposes of this application, the term "roller" encompasses devices having any cross-sectional shape. More specifically, the term roller includes devices which have circular cross-sectional shapes as well as devices which have non-circular cross-sectional shapes such as octagonal, rectangular, triangular or any other cross-sectional shape as shown in FIG. 12A.

An alternative coloring device 110 constructed in accordance with the teachings of the instant invention is illustrated in FIGS. 14–17. As illustrated in those figures, this alternative embodiment is similar in many respects to the preferred embodiment described above. Thus, the following description will focus on only those aspects of the alternative coloring device 110 which differ from the other disclosed embodiment. Unless otherwise specified, those skilled in the art will thus, appreciate that any structures not described in connection with this alternative embodiment can be implemented in the same manner as the corresponding structures disclosed in connection with the other embodiment.

Figure 15:
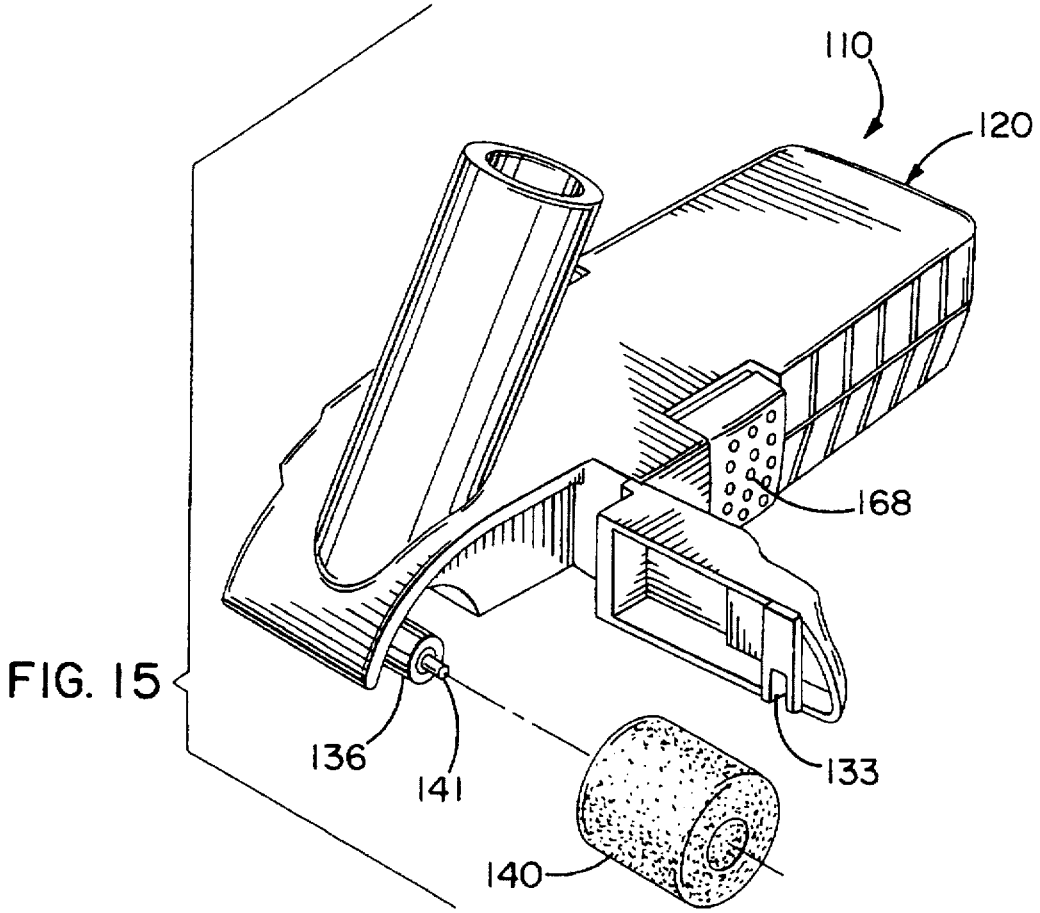
FIG. 15 is a view similar to FIG. 14 but illustrating the alternative coloring device with its roller compartment door open and its roller removed.
Figure 16:
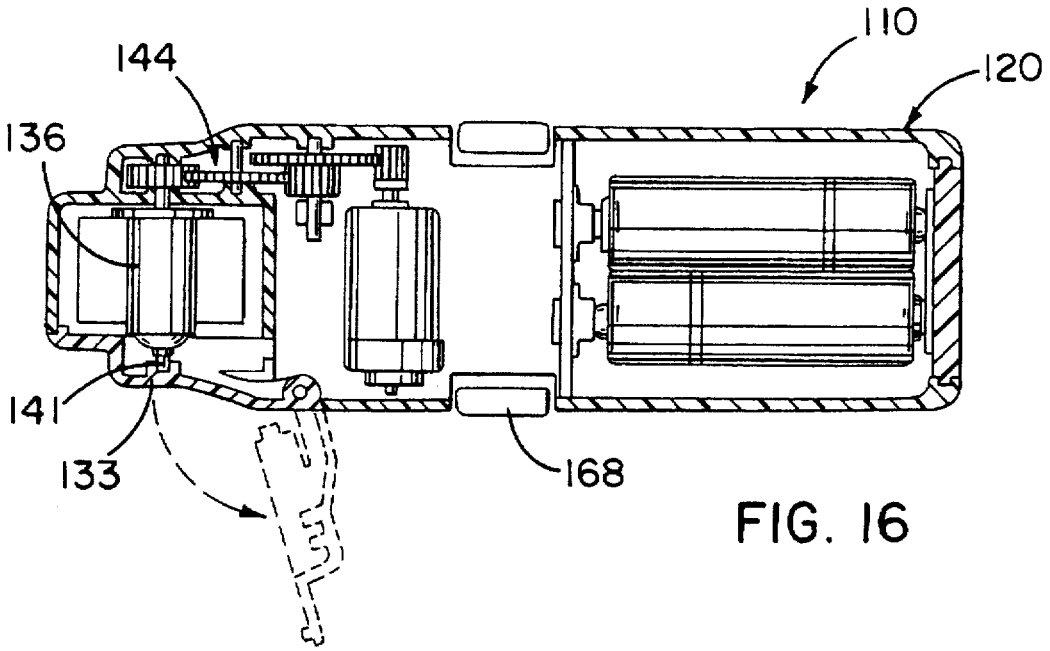
FIG. 16 is a top view of the alternative coloring device of FIG. 14 with the housing removed along line 16—16 of FIG. 14 to reveal the internal components of the coloring device.

As illustrated in FIGS. 15 and 16, one difference between the coloring device 110 illustrated in FIGS. 14–17 and the embodiment described above, is the manner in which the roller 140 is supported. More specifically, whereas in the above-described embodiment, the roller 40 was supported on a spindle 36 having one free end and one end coupled to a gear train 45, in this embodiment 110, the spindle 136 does not include a free end. Instead both ends of the spindle 136 are supported during use.

To this end, the coloring device 110 includes a pivotable door 135 having a support 133 which engages a pin or trunnion 141 on the spindle 136. Thus, in this embodiment 110, one end of the spindle 136 interacts with the gear train 144 and the other end interacts with the pivotable door 135 to help limit eccentric rotation of the roller 140. The pivotable door 135 can be pivoted to provide access to the roller 140 for replacement and the like.

This embodiment of the coloring device 110 is also different from the earlier described embodiment in the location of its switch 168. Specifically, as shown in FIGS. 15 and 16, this embodiment employs a switch on the side of the housing 120 rather than the top of the housing.

Those skilled in the art will appreciate that the insert 30 illustrated in FIGS. 18 and 19, and the alternative means for rotating illustrated in FIG. 21, could be used with the alternative embodiment illustrated in FIGS. 14–17 without departing from the scope or the spirit of the instant invention.

Figure 8:
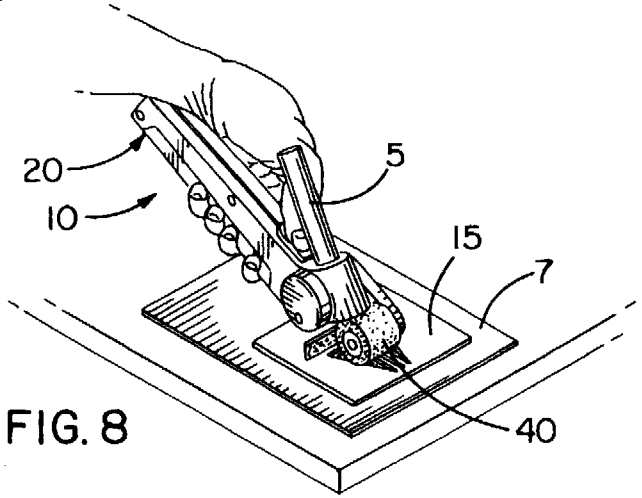
FIG. 8 is a left, front perspective view of the coloring device of FIG. 1 being used in conjunction with a stencil.

In accordance with one optional aspect of the invention, the coloring device can be used in conjunction with a stencil 15 as illustrated in FIG. 8. Such a stencil 15 would be constructed with one or more openings that provide limited access to a surface 7 to be marked. Thus, if the coloring device 10 is used to transfer a coloring material through the stencil 15, a pattern corresponding to the openings made on the surface to be made on the surface 7 to be marked. Although the stencil illustrated in FIG. 8 is designed to create an image of a sail boat, those skilled in the art will appreciate that stencils 15 having openings of virtually any shape could be used in this role.

Figure 13:
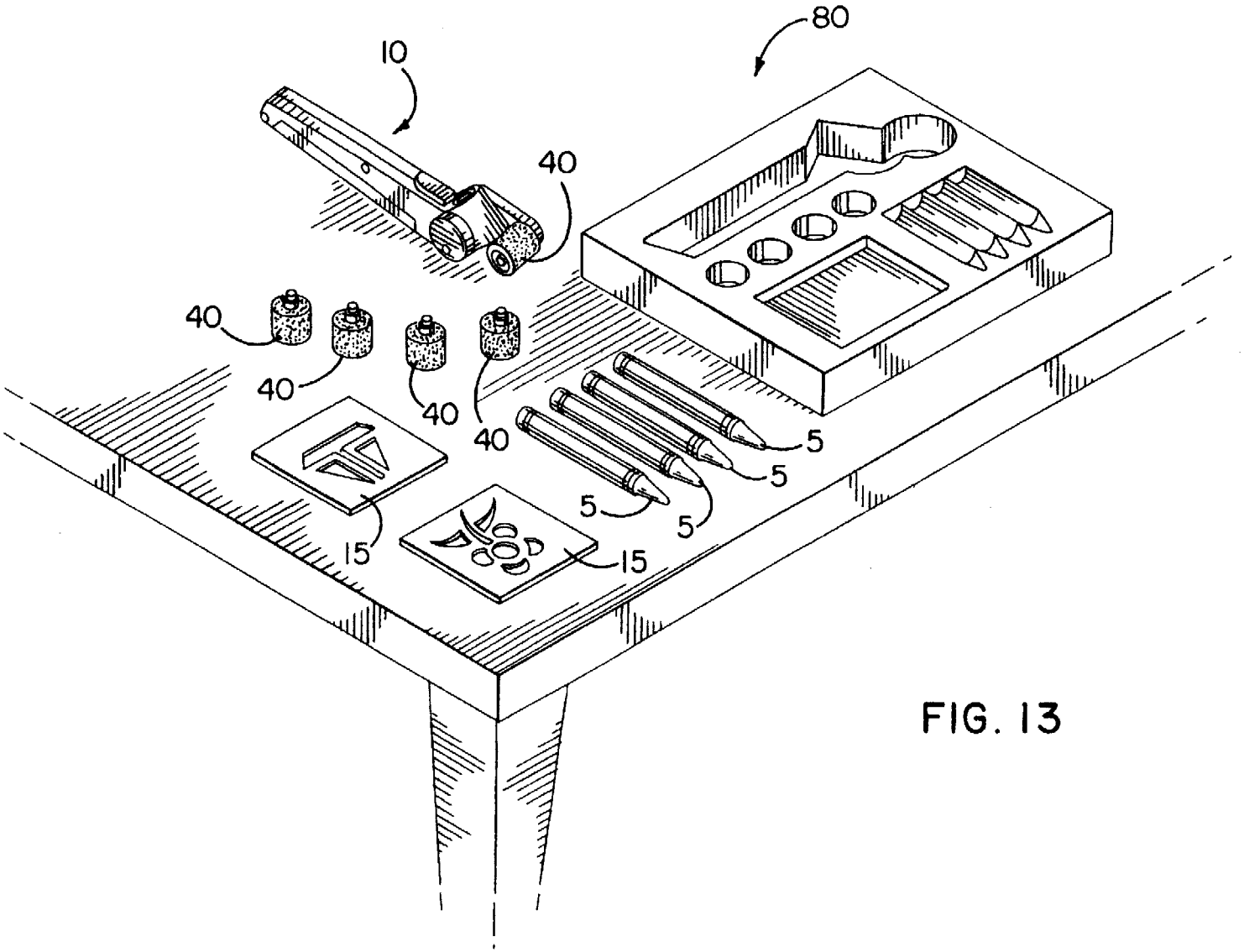
FIG. 13 is a left, front perspective view of a kit which is constructed in accordance with the teachings of the instant invention and which is positioned on a table for ease of viewing.
Figure 14:
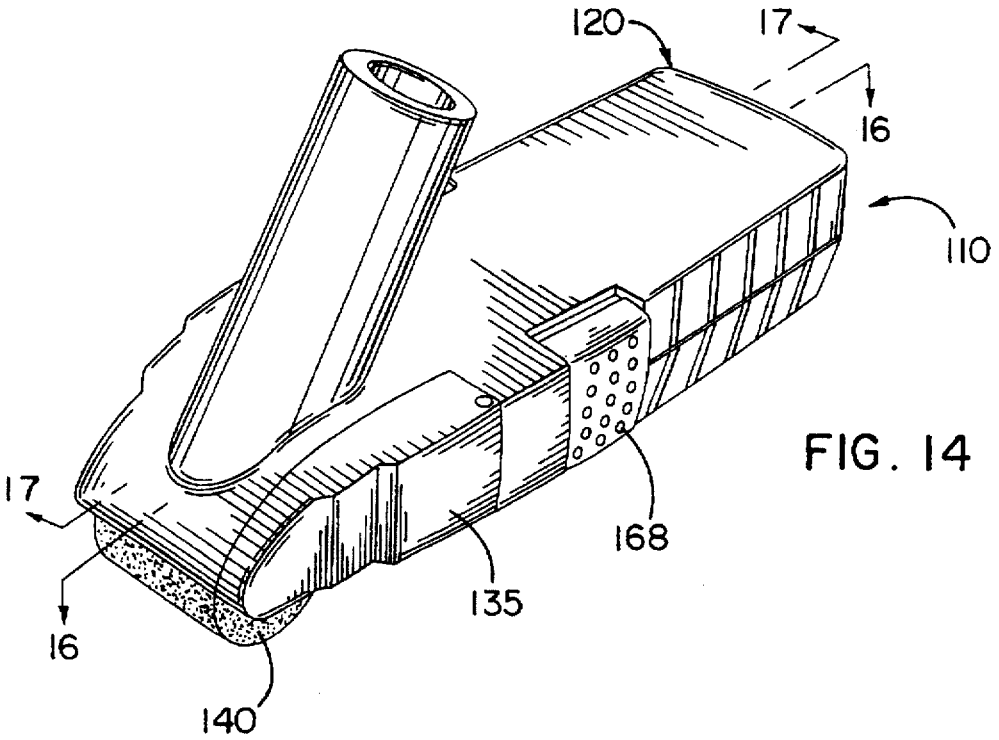
FIG. 14 is a right, front perspective view of an alternative coloring device constructed in accordance with the teachings of the instant invention.

In accordance with another optional aspect of the invention, the coloring device can be included in a kit 80. In the illustrated embodiment shown in FIG. 13, the kit 80 includes a coloring device 10, five interchangeable rollers 40, two stencils 15, four different colored crayons 5, and a molded plastic tray to store the individual components.

The coloring device 10 and kit 80 can be used in the following manner. A user opens the kit 80 and places a writing instrument 5 having a transferrable coloring material in contact with the roller 40 of the coloring device 10. If the writing instrument is a crayon, either the pointed end or the flat end can contact the roller 40. The user can begin rotating the roller 40 either before or after positioning the writing instrument 5 in the coloring device 10. Thus, if the user has not already done so, the user would next begin rotating the roller 40 to transfer the coloring material from the writing instrument 5 to the roller 40. By positioning the rotating roller 40 in contact with a surface to be marked, the user will transfer the coloring material from the roller 40 to that surface 7. If desired, the user can position a stencil 15 on the surface 7 to be marked and use the coloring device 10 as described above to color in one or more areas exposed by the stencil or template 15.

If desired, a user can then replace the roller 40 with a new roller from the kit 80. The user can also replace the writing instrument 5 with a new writing instrument, perhaps having a different colored material or carrying a coloring material of a different type (for example, replacing a blue crayon with a red crayon; replacing a red crayon with a yellow marker; or replacing a yellow marker with a yellow crayon). The use of different types or sizes of instruments 5 could require the user to employ the insert 30 with the coloring device 10. The interchangeability of these writing instruments 5 enables the user to create multi-colored images with a wide range of visual effects.

For example, if the user wanted to apply a large amount of coloring material, then the user would hold the roller in contact with the surface for a longer period of time and/or apply more pressure to the surface. If the user wanted to apply a small amount of coloring material, then the user would hold the roller in contact with the surface for a shorter period of time and/or apply less pressure to the surface. If the user wants to blend or feather the coloring material with the surface, then the user would remove the writing instrument and wear off the coloring material from the roller as the user moves the roller away from the area with coloring material and/or apply less pressure to the surface as the user moves the roller away from the area with coloring material. The end result is that the user is able to achieve an airbrush effect by using the invention.

In addition, the user may wish to combine or blend two or more colors. To this end, the user would apply a first coloring material to the surface. Then the user would use either the same roller with a writing instrument containing a second coloring material or a second roller with a second coloring material to blend the coloring materials on the surface to achieve the desired color or effect. If desired, a user could use the above described methods to achieve an airbrush effect while blending the coloring materials.

It should be noted that although the above description of one optional method of use of the kit 80 refers to the first described embodiment 10 of the inventive coloring device, any other embodiment of the coloring device can be employed in the above-described method or kit 80 without departing from the scope or the spirit of the invention. It should further be noted that, although the invention has been described in connection with certain embodiments, there is no intent to in any way limit the invention to those embodiments. On the contrary, the intent is to cover all alternatives, modifications and equivalents included within the spirit and scope of the invention as defined by the appended claims.

What is claimed is:

1. A coloring device for transferring coloring material from a crayon to a surface to be marked comprising:

a rotatable roller for selectively contacting the surface to be marked;

a housing supporting the roller and including a holder in proximity to the roller, the holder being positioned to hold a crayon in contact with the roller; and, means independent of contact between the roller and the surface to be marked for rotating the roller about an axis of rotation such that the roller obtains coloring material from a crayon and, upon contacting the surface to be marked, transfers the coloring material to the surface to be marked.

2. A coloring device as defined in claim 1 wherein the roller is removable.

3. A coloring device as defined in claim 1 wherein the roller includes two opposed ends and the housing supports both of the ends of the roller.

4. A coloring device as defined in claim 1 wherein the roller includes two opposed ends and the housing only supports one of the ends of the roller.

5. A coloring device as defined in claim 1 wherein the roller has a non-circular cross-section.

6. A coloring device as defined in claim 1 wherein the roller has a circular cross-section.

7. A coloring device as defined in claim 1 wherein the housing defines a handle.

8. A coloring device as defined in claim 1 wherein the housing includes a rotatable spindle, the roller being disposed on the spindle such that the spindle defines the axis of rotation.

9. A coloring device as defined in claim 1 wherein the holder secures a crayon having a first cross-section.

10. A coloring device as defined in claim 9 further comprising an insert removably coupled to the holder for adapting the holder to secure crayons having a second cross-section different from the first cross-section.

11. A coloring device as defined in claim 1 wherein the means for rotating comprises a motor.

12. A coloring device as defined in claim 11 further comprising a gear train for transferring the rotational motion of the motor to the roller.

13. A coloring device as defined in claim 11 wherein the housing includes a manually engageable switch electrically coupled to the motor for controlling the operation thereof.

14. A coloring device as defined in claim 1 wherein the means for rotating comprises a manually engageable crank coupled to the roller such that rotation of the crank causes rotation of the roller.

15. A coloring device as defined in claim 14 further comprising a gear train for transferring the rotational motion of the crank to the roller.

16. A coloring device as defined in claim 1 further comprising a crayon.

17. A coloring device as defined in claim 1 further comprising a stencil having at least one opening for exposing at least one predetermined area of the surface to be marked to the roller to create at least one predetermined image thereon.

18. A coloring device for transferring coloring material to a surface to be marked from either a first writing instrument having a first cross-section or a second writing instrument having a second cross-section which is different from the first cross-section, the coloring device comprising:

a rotatable roller for selectively contacting the surface to be marked;

a housing supporting the roller and including a holder in proximity to the roller, the holder being positioned to hold the first writing instrument in contact with the roller;

an insert removably coupled to the holder for adapting the holder to secure the second writing instrument in contact with the roller; and means for rotating the roller about an axis of rotation such that the roller obtains coloring material from the writing instrument secured by the holder and, upon contacting the surface to be marked, transfers the coloring material to the surface to be marked.

19. A coloring device for transferring coloring material to a surface to be marked from either a first writing instrument having a first cross-section or a second writing instrument having a second cross-section which is different from the first cross-section, the coloring device comprising:

a housing including a holder to hold a first instrument;

an insert removably coupled to the holder for adapting the holder to secure a second writing instrument; and, a roller connected to the housing for rotation about an axis, the roller being positioned to contact a writing instrument disposed in the holder to obtain coloring material therefrom and further being positioned to contact a surface to transfer the coloring material obtained from the writing instrument thereto as the roller rotates about the axis.

20. A coloring device for transferring coloring material from a marker to a surface to be marked comprising:

a rotatable roller for selectively contacting the surface to be marked;

a housing supporting the roller and including a holder in proximity to the roller, the holder being positioned to hold a marker in contact with the roller; and, means independent of contact between the roller and the surface to be marked for rotating the roller about an axis of rotation such that the roller obtains coloring material from a marker and, upon contacting the surface to be marked, transfers the coloring material to the surface to be marked.

21. A coloring device as defined in claim 20 wherein the roller is removable.

22. A coloring device as defined in claim 20 wherein the roller includes two opposed ends and the housing supports both of the ends of the roller.

23. A coloring device as defined in claim 20 wherein the roller includes two opposed ends and the housing only supports one of the ends of the roller.

24. A coloring device as defined in claim 20 wherein the roller has a non-circular cross-section.

25. A coloring device as defined in claim 20 wherein the roller has a circular cross-section.

26. A coloring device as defined in claim 20 wherein the housing defines the handle.

27. A coloring device as defined in claim 20 wherein the housing includes a rotatable spindle, the roller being disposed on the spindle such that the spindle defines the axis of rotation.

28. A coloring device as defined in claim 20 wherein the holder secures a marker having a first cross-section.

29. A coloring device as defined in claim 20 wherein the means for rotating comprises a motor.

30. A coloring device as defined in claim 20 wherein the means for rotating comprises a manually engageable crank coupled to the roller such that rotation of the crank causes rotation of the roller.

31. A coloring device as defined in claim 20 further comprising a marker.

32. A coloring device as defined in claim 20 further comprising a stencil having at least one opening for exposing at least one predetermined area of the surface to be marked to the roller to create at least one predetermined image thereon.

33. A coloring device as defined in claim 28 further comprising an insert removably coupled to the holder for adapting the holder to secure markers having a second cross-section different from the first cross-section.

34. A coloring device as defined in claim 29 further comprising a gear train for transferring the rotational motion of the motor to the roller.

35. A coloring device as defined in claim 29 wherein the housing includes a manually engageable switch electrically coupled to the motor for controlling the operation thereof.

36. A coloring device as defined in claim 30 further comprising a gear train for transferring the rotational motion of the crank to the roller.

37. A coloring device for transferring coloring material from a writing instrument to a surface to be marked comprising:

a rotatable roller for selectively contacting the surface to be marked;

a housing supporting the roller and including a holder in proximity to the roller, the holder being positioned to hold a writing instrument in contact with the roller; and, means independent of contact between the roller and the surface to be marked for rotating the roller about an axis of rotation such that the roller obtains coloring material from a writing instrument and, upon contacting the surface to be marked, transfers the coloring material to the surface to be marked.

38. A coloring device as defined in claim 37 further comprising a writing instrument, wherein the writing instrument is selected from the group consisting of a stick of chalk and a painting stick.

39. A coloring device as defined in claim 37 wherein the roller is removable.

40. A coloring device as defined in claim 37 wherein the roller includes two opposed ends and the housing supports both of the ends of the roller.

41. A coloring device as defined in claim 37 wherein the roller includes two opposed ends and the housing only supports one of the ends of the roller.

42. A coloring device as defined in claim 37 wherein the roller has a non-circular cross-section.

43. A coloring device as defined in claim 37 wherein the roller has a circular cross-section.

44. A coloring device as defined in claim 37 wherein the housing defines the handle.

45. A coloring device as defined in claim 37 wherein the housing includes a rotatable spindle, the roller being disposed on the spindle such that the spindle defines the axis of rotation.

46. A coloring device as defined in claim 37 wherein the holder secures a writing instrument having a first cross-section.

47. A coloring device as defined in claim 37 wherein the means for rotating comprises a motor.

48. A coloring device as defined in claim 37 wherein the means for rotating comprises a manually engageable crank coupled to the roller such that rotation of the crank causes rotation of the roller.

49. A coloring device as defined in claim 37 further comprising a stencil having at least one opening for exposing at least one predetermined area of the surface to be marked to the roller to create at least one predetermined image thereon.

50. A coloring device as defined in claim 46 further comprising an insert removably coupled to the holder for adapting the holder to secure writing instruments having a second cross-section different from the first cross-section.

51. A coloring device as defined in claim 47 further comprising a gear train for transferring the rotational motion of the motor to the roller.

52. A coloring device as defined in claim 47 wherein the housing includes a manually engageable switch electrically coupled to the motor for controlling the operation thereof.

53. A coloring device as defined in claim 48 further comprising a gear train for transferring the rotational motion of the crank to the roller.

* * * * *

UNITED STATES PATENT AND TRADEMARK OFFICE

CERTIFICATE OF CORRECTION

PATENT NO. : 5,685,224

DATED : November 11, 1997

INVENTOR(S) : Bryan L. Dean; Victor G. Reiling, Jr.

It is certified that error appears in the above-identified patent and that said Letters Patent is hereby corrected as shown below:

On the Title Page:
[56] References: Foreign Patent Documents
Col. 1, line 5, "184380" should read --184830--

On page 2, Col. 1, line 11, "2/1923" should read --12/1923--

In the specification:

Col. 3, lines 10 and 11, "in FIG. 10" should be printed on the same line. No new paragraph here.

Col. 7, line 35: "made" should read --in the stencil 15 will be--

Col. 7, line 36, delete "surface to be made on the"

Signed and Sealed this

Twenty-eighth Day of April, 1998

Bruce Lehman

*Attest:*

BRUCE LEHMAN

*Attesting Officer*

*Commissioner of Patents and Trademarks*